US005765476A

United States Patent [19]

McKeever

[11] Patent Number: 5,765,476

[45] Date of Patent: Jun. 16, 1998

[54] DEVICE FOR SETUP OF OFF-CONTACT IN SCREEN PRINTING MACHINES

[75] Inventor: Thomas A. McKeever, Maple Shade, N.J.

[73] Assignee: Stretch Devices, Inc., Philadelphia, Pa.

[21] Appl. No.: 720,981

[22] Filed: Oct. 15, 1996

[51] Int. Cl.[6] ..... B41F 15/34

[52] U.S. Cl. ..... 101/127.1; 101/126; 101/DIG. 36; 33/614

[58] Field of Search ..... 101/126, 127.1, 101/128.1, 128, 129, 115, DIG. 36; 33/614, 621, 623

[56] References Cited

U.S. PATENT DOCUMENTS

| | | | |
|---|---|---|---|
| 3,943,851 | 3/1976 | Inada et al. | 101/127.1 |
| 4,226,181 | 10/1980 | Ericsson | 101/129 |
| 4,938,130 | 7/1990 | Thorpe | 101/126 |
| 5,148,745 | 9/1992 | Hamu | 101/127.1 |
| 5,188,026 | 2/1993 | Fuqua et al. | 101/129 |
| 5,226,366 | 7/1993 | Schlife et al. | 101/485 |
| 5,315,929 | 5/1994 | Sundqvist | 101/127.1 |
| 5,503,068 | 4/1996 | Newman | 101/126 |

*Primary Examiner*—Christopher A. Bennett

*Attorney, Agent, or Firm*—Seidel, Gonda, Lavorgna & Monaco, PC

[57] ABSTRACT

An off-contact setup device is provided for a screen printing type machine. The setup device includes a frame that releasably clamps onto a levelled image pallet of the screen printing machine. The height of the setup frame relative to the pallet surface is adjusted. This height is calibrated to a desired off-contact distance between a printing screen and the substrate to be printed (which is positioned on the pallet during printing). The frame holding arm of the printing machine, which is used to support the screen printing frame, is brought into position and secured to the setup frame. The height and level adjustments for the screen frame holding assembly are then fixed so as to conform to the position of the setup frame on the pallet. This process is repeated for all stations on the printing machine. Thus, the relative distance between all pallets and the screen printing frames attached to the holding assemblies are set to be the same, providing a consistent printing operation.

12 Claims, 3 Drawing Sheets

DEVICE FOR SETUP OF OFF-CONTACT IN SCREEN PRINTING MACHINES

FIELD OF THE INVENTION

The present invention relates to a device for setting the image pallets and the screen frame holding assemblies of a multi-station screen printing machine at a uniform off-contact distance for the printing screen.

BACKGROUND OF THE INVENTION

In screen printing operations, ink is "squeegeed" through a stenciled image on a porous screen onto a substrate such as fabric, metal, plastic, glass, etc. Typically, the printing screen is stretched smoothly and tightly on a substantially rigid frame. The substrate which is to receive the image is disposed on a pallet or other support surface below the screen. It has been determined that the distance between the screen and the printing substrate, known as the "off-contact" distance, is critical to an effective printing operation.

Screen printing presses designed for multi-color graphics employ multiple printing stations comprising a plurality of screen frame holding assemblies and a plurality of image supporting pallets. In a carousel type press, the frame holders and image pallets are supported on separate sets of cantilevered arms. The frame arms and pallet arms extend radially from a central axis and rotate relative to each other around the axis. In addition, the frame holders are movable vertically relative to the image pallet in order to vary the off-contact distance between the screen on the frames and substrates on the image pallet.

Within a multi-color printing operation it is desirable that each screen frame register precisely with a predetermined area of the pallet supporting the printing substrate. This enables the printed image to be placed at exactly the same location on the substrate by each of the printing frames on the press. Pin registration mechanisms are sometimes provided to facilitate accurate registration of each screen frame with the image pallet. U.S. Pat. Nos. 5,377,422 and 5,522,148 disclose registration systems for roller type screen printing frames (such as those disclosed in U.S. Pat. Nos. 3,908,293 and 4,345,390).

For the same reason that accurate registration is important (i.e., promoting image quality), it is important that the off-contact distance between the image pallets and the printing frames be equivalent for all positions on the multi-station printing press. Typically, this is accomplished by separately levelling each and every image pallet and each and every screen frame holding assembly using a "spirit level" or other leveling device. This method, however, is an inefficient, time-consuming, and not always accurate.

SUMMARY OF THE INVENTION

The present invention is directed to an off-contact setup device having a substantially rectangular frame. Releasable pallet clamps are provided on the frame for clamping the setup device to an image pallet on a printing press. Multiple threaded shafts are provided on the frame at various positions. The ends of the shafts extend through the frame with a flat distal end contacting the pallet to which the frame is clamped. Rotation of the shafts raise or lower the frame relative to the pallet. The frame is then secured within a holding assembly on the printing machine. Upon fixing the adjustments of the frame holding assembly, the off-contact device sets the relative distance of the frame to the pallet.

To prepare the screen printing machine for printing, a setup device is brought into position over a pre-levelled image pallet. The setup device is then clamped to the pallet. The amount of off-contact desired for printing is then set by rotation of the shafts. The screen frame holding assembly is brought into engagement with the setup device. The holder assembly is adjusted to fix the holder in the desired position with respect to the pallet as set by the setup frame. The setup device is released from the holding assembly and a new holding assembly is positioned over the pallet and setup frame and similarly adjusted. This procedure fixes the off-contact distance for all holding assemblies to the same level. Thereafter, the position of the remaining pallets is checked by means of the setup frame. When the last screen frame holding assembly and pallet has been adjusted, the setup device is removed and the screen printing frames are then fixed into position within the adjusted holding assemblies.

Further features and advantages of the present invention will become apparent to those skilled in the art upon reviewing and comprehending the embodiment described below and illustrated in the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
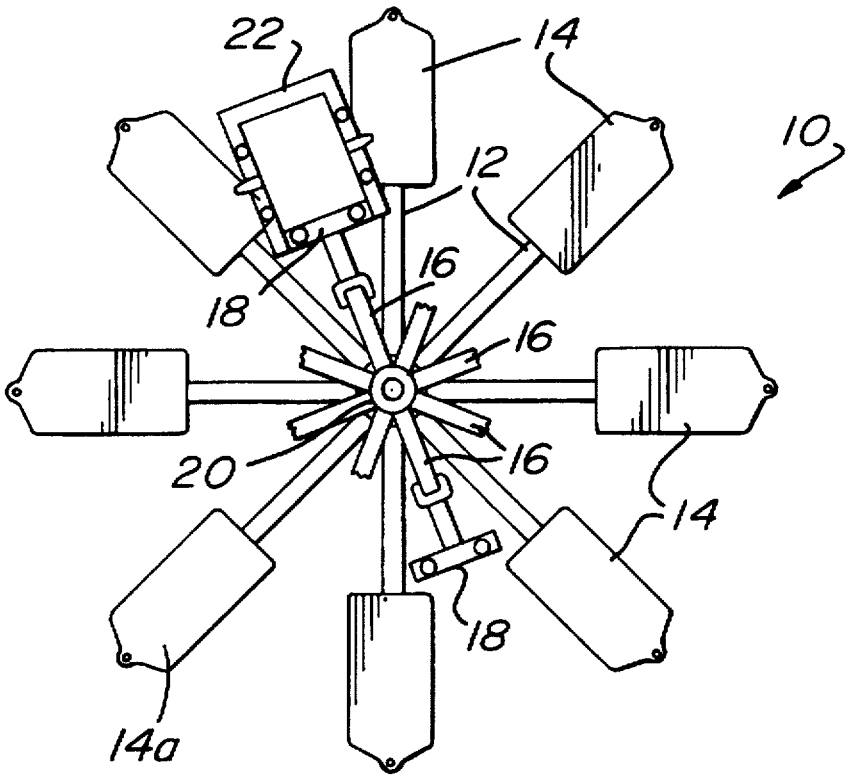
FIG. 1 is a top view of a multi-station screen printing press having a plurality of image pallets and frame holding assemblies and having mounted thereon an off-contact setup device in accordance with the present invention.

In the drawings where like numerals identify like elements there is shown a multi-station screen printing press of a type generally known in the art. The press is generally identified by the numeral 10 and, as illustrated in FIG. 1, includes eight (8) printing stations. Each printing station includes a plurality of pallet arms 12 each supporting an image pallet 14 and a plurality of frame holding arms 16 each supporting a separate screen frame holding assembly 18. The pallet arms 12 and the frame holding arms 16 extend radially from a central hub 20 and are independently rotatable about the axis formed by the hub 20. For purposes of clarity in FIG. 1, a number of the holding arms are shown with the frame holding assemblies removed from view.

The printing press 10 which is graphically illustrated in FIG. 1 is known as a carousel type. There are a number of designs of presses of this type which perform similar operations. Each of these known presses are typically capable of performing a screen printing operation at each station. Each station is used to apply a different color for or portion of the overall image. The holding assemblies 18 are used to retain a screen printing frame (not shown) which retains a tensioned fabric or printing screen having a stencilled image thereon. Known printing frames of the type including a series of rotatable rollers, such as those sold under the registered trademark NEWMAN ROLLER FRAME by Stretch Devices, Inc. of Philadelphia, Pa. are but one example of a printing frame for use in a carousel printing press.

During the printing operation, the printing press 10 retains a printing frame (not shown) at the end of the frame holding arm 16. The frame holding assembly 18 secures the frame in a cantilevered fashion. In FIG. 1, the holding assembly is shown as engaging an off-contact setup frame 22 as contemplated by the present invention. This setup frame 22 is described in more detail below.

Figure 2:
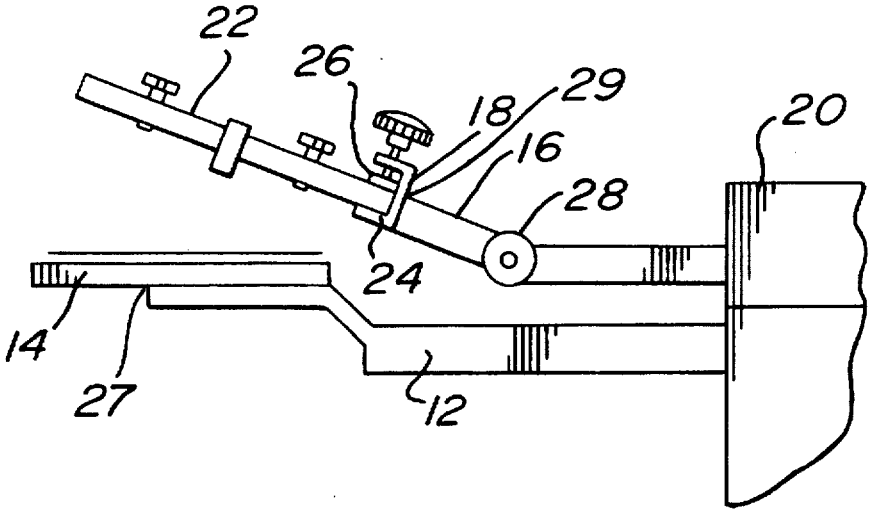
FIG. 2 is a partial side elevational view of one station of a multi-station screen printing press having mounted thereon an off-contact setup device in accordance with the present invention.

As illustrated more particularly in FIG. 2, the holding assembly 18 is in the form of an adjustable frame clamp having an elongated "C"-shaped channel 24 and two rotatable clamping members 26. One edge of the frame, which in FIG. 2 is the setup frame 22, is positioned within the channel 24 and secured therein by means of rotating the clamping members 24. A pivot or hinge 28 is provided within the frame holding arm 16 such that the frame 22 may be retracted from its position over the pallet 14.

Although not illustrated in FIGS. 1 and 2, a typical printing press includes adjustment mechanisms 27 for leveling the pallet mechanisms 29 for leveling the frame holding assembly 18 and and the printing frame (when secured in the holding assembly) and for setting the off-contact distance between the screen on the frame and the substrate positioned on the image pallet.

Figure 3:
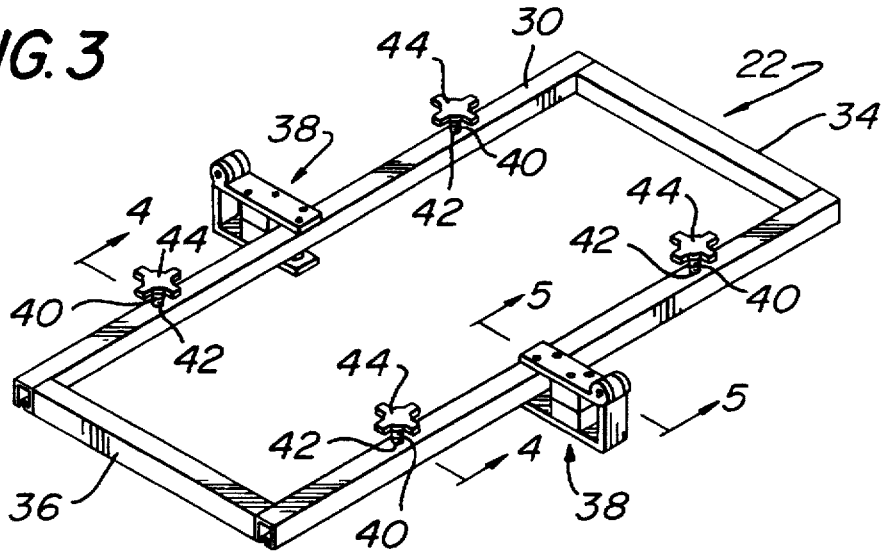
FIG. 3 is a perspective view of an off-contact setup device in accordance with the present invention.

In FIG. 3 there is illustrated in detail the structure of the off-contact setup frame 22 as contemplated by the present invention. The setup frame 22 generally has a rectangular construction composed of two parallel side members 30, 32, a top member 34 at one end of the two side members 30, 32, and a bottom member 36 positioned at the opposite end of the frame 22 from the top member 34. The frame is constructed of extruded aluminum bars which are cut to the desired size and then welded or bolted together at the corners of the frame. It is desirable that the frame 22 be rigid and generally planar. A releasable pallet clamp 38 is provided on each side member 30, 32 at a generally medial position between the top member 34 and bottom member 36. Also provided on the frame are four (4) adjustment shafts 40. Each shaft is externally threaded and is retained within an internally threaded opening 42 within the side members 30 and 32. A knob 44 is provided on one end of each shaft 40 and is journaled or secured thereto such that rotation of the knob 44 causes a similar rotation of the shaft 40.

Figure 4:
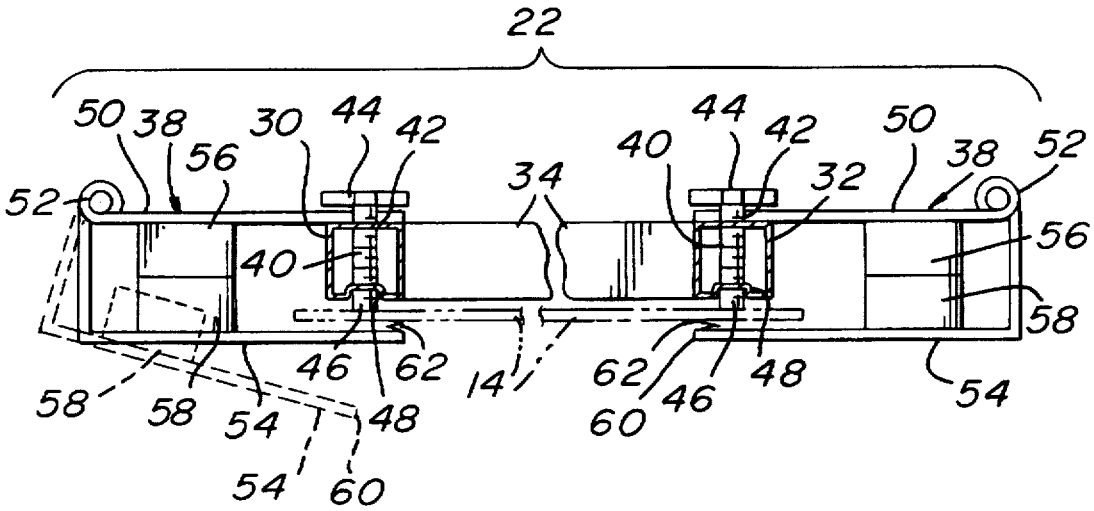
FIG. 4 is a cross-sectional view of the off-contact setup device as taken along line 4—4 in FIG. 3 and showing in phantom an image pallet attached thereto.
Figure 5:
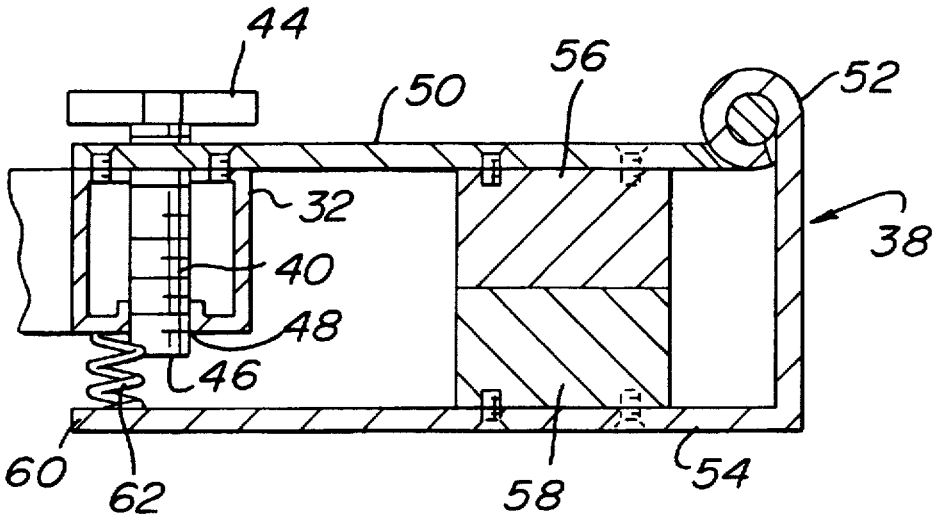
FIG. 5 is a cross-sectional view of a pallet clamp portion of the off-contact setup device as taken along line 5—5 in FIG. 3.

As is more particularly illustrated in the cross-section which is FIG. 4, each shaft is positioned generally perpendicular to the plane of the frame 22. Each of the knobs 44 are positioned on the same side of the frame 22 and define the top surface of the frame. Shown in phantom in FIG. 4 is a pallet 14. The frame 22 is generally supported on the pallet 14 by means of the shafts 40. The ends 46 of the shafts 40 extend below the bottom of the side members 30, 32 and are brought into contact with the top surface of the pallet 14. As can be seen in FIGS. 4 and 5, the bottom surface of each side member 30, 32 includes a channel 48 through which the ends 46 of the shafts 40 project. By rotation of the knobs 44, the amount of projection of the ends 46 of the shafts is varied. The variation of the projection of the shaft ends 46 also adjusts the position of the frame 22 above the pallet 14.

As can also be seen in FIGS. 4 and 5, the frame 22 is secured to the pallet by means of the pallet clamps 38 which are positioned on the opposing side members 30 and 32. As illustrated, each clamp 38 includes a top member 50 which is fixed to the upper surface of the respective side member 30, 32. The top member 50 projects outwardly from the frame 22 and terminates at a hinge 52. Also connected to the hinge 52 is an L-shaped member 54 which forms the bottom portion of the clamp 38. On the inside surfaces of the top member 50 and the bottom member 54 are provided magnets 56 and 58, respectively. The two magnets 56, 58 are formed such that they attract one another and are positioned on the top portion 50 and bottom portion 54 of the clamp 38 such that they are adjacent to one another when the clamp 38 is closed. To open the clamp 38, the magnetic attraction force must be overcome in pivoting the bottom member 54 away from the top member 50. In FIG. 4, the bottom member 54 is shown in phantom in the open or pivoted position.

In clamping the frame 22 to the pallet 14, the bottom member 54 of the clamp 38 is rotated upwardly into the closed position. The end 60 of the bottom member projects inwardly to a position inside of the edge of the pallet 14 and preferably inside of the supporting end 46 of the shaft 40. The attraction of the two magnets 56, 58 secures the clamp 38 in the closed position. As particularly illustrated in FIG. 5, the inwardly projected end 60 of the bottom member 54 of the clamp 38 includes an upwardly projected spring 62. The spring 62 is provided for resilient engagement with the bottom of the pallet 14. The resiliency of the spring 62 permits the clamp 38 to engage pallets 14 of various thicknesses without requiring additional projection of the ends 46 of the shafts 40 from the bottom of the frame 22.

In operation, the setup frame 22 is secured to a pallet 14 by means of the clamps 38. The pallet 14 has been previously levelled by any conventional leveling device, such as a spirit level. Each clamp 38 is opened by forcing the bottom L-shaped 54 member downward against the attractive force of the magnets 56, 58. The frame 22 is then positioned on the pallet 14 with the extended ends 46 of the rotatable shafts 40 sitting on the upper surface of the pallet 14. The clamps 38 are then closed, with the projected end 60 of the bottom member 54 of the clamp 38 being positioned under the pallet and the spring 62 (FIG. 5) compressing to secure the frame 22 in position.

One aspect of the setup frame 22 that may be considered important is the use of releasable clamps. In the embodiment shown, the releasability of the clamps 38 is created by the use of magnets 56, 58 to close the clamp and fix it to the pallet 14. If for some reason a lifting force is applied to the frame 22 when it is fixed to the pallet 14, the clamps 38 may release prior to causing damage to the setup frame, the pallet or the other portions of the printing machine. Other types of closure mechanisms may be utilized as desired. As an example, springs may be fixed between the top and bottom members of the clamp. The attachment of the spring may be at an angle such that the closing force is varied depending on the position of the clamp about the hinge.

Once the frame 22 is positioned on the pallet 14, the knobs 44 at the top end of the shafts 40 are rotated to set the height of the frame 22 above the top surface of the pallet 14. The rotation of the shaft 40 within the threaded opening 42 in the side members 30 or 32 of the frame 22 varies the amount of extension by the end 46 of the shaft 40 from the bottom channel 48 and, in turn, sets the spacing between the frame 22 and the pallet 14. The knobs 44 may include calibration markings (not shown) to indicate the amount of extension of the shaft ends 46 from the bottom surface of the frame. The calibration markings will relate directly to the amount of off-contact of a printing screen from a substrate positioned on the image pallet 14. Preferably, the rotation of the shafts will be limited by a stopping means (not shown) such that the calibration can be varied only over a single rotation of the shaft. Also, it is preferred that the pitch of the threads on the shaft be ⅛ of an inch. This should provide a useful adjustment of the off-contact distance.

To conform the printing machine 10 to the desired off-contact as set by the setup frame 22, the frame holding arms 16 are rotated around the hub 20 of the machine 10 such that a frame holding assembly 18*a* is positioned over the pallet 14 having the setup frame 22 thereon. The frame holding assembly is then secured to the frame 22 such as by having the top member 34 of the frame 22 positioned within the C-shaped channel 24 and by the rotatable clamping members 26 securing the frame 22 therein (FIG. 2). After the frame 22 is secured to the frame holding assembly 18*a*, the height and level adjustment mechanisms 29 for the assembly 18*a* are fixed. Thus, the position of the frame holding assembly 18*a* within the printing machine 10 is set to the off-contact distance as defined by the setup frame 22 secured to the pallet 14.

After fixing a first frame holding assembly 18, the clamping members 26 are released and the assembly 18 is removed from the setup frame 22. The release of the frame 22 by the clamping members 26, however, does not release the other adjustments 29 for the assembly 18. Thus, the off-contact position for the holding assembly 18*a* remains fixed. Once the fixed frame holding assembly is released, another assembly is brought into position, clamped to the setup frame 22 which remains on the pallet 14, and fixed to the off-contact height set by the frame 22. This process is repeated until all frame holding arms 16 are adjusted to the same position.

After adjusting the last frame holding assembly 18, the setup frame 22 is released from the pallet 14. The frame 22 is preferably retained within the last holding assembly 18 and lifted from the pallet 14, similar to the lifting of a printing frame during the printing operation. The setup frame is then set on another pallet 14 to confirm the position of the pallet 14. If adjustments are required in order to set the same off-contact distance between this second pallet 14 and the frame holding assemblies 18 (as previously adjusted), the height and level adjustment mechanisms 27 for the pallet (not shown) are changed so as to bring the second pallet 14 into the identical position as the original pallet 14 relative to the position of the holding assemblies 18. This process is again repeated until all pallets 14 are set to the same position. The setup frame 22 is then removed from the holding assembly 18 and the printing frames (not shown) are secured within the holding assemblies 18 for purposes of printing.

The fixing of a consistent off-contact printing distance for a printing screen with respect to a substrate positioned on a pallet is considered to be important to controlling the overall printing operation. A fixed off-contact provides consistency in color and ink usage. Other advantages should be understood by those skilled in the art.

It is contemplated that the structure of the setup frame as described herein may varied without departing from the present invention. Moreover, it is further contemplated that the setup frame of the invention may be used in printing machines made by any number of manufacturers. Variation in the dimensions of the frame members and the overall length and width of the frame are also contemplated. Such modification may be incorporated to account for differences in the clamping mechanisms on the printing machine, the size and shape of the pallets, the structure of the frame holding arms, etc. It is further contemplated that the setup frame of the present invention may be utilized in both manual and automatic screen printing machines as well as machines which are not necessarily classified as being of the carousel type.

The present invention may be embodied in other specific forms without departing from the spirit or essential attributes thereof and, accordingly, reference should be made to the appended claims, rather than to the foregoing specification, as indicating the scope of the invention.

What is claimed is:

1. A device for setting a uniform off-contact distance in a screen printing machine prior to printing, the device comprising:

a rigid frame, the frame adapted to be engaged by at least one clamp of a screen frame holding assembly of the screen printing machine;

means for securing the frame on the surface of a pallet of the screen printing machine; and means for adjusting the relative height of the frame with respect to the surface of the pallet.

2. A device as claimed in claim 1 wherein the frame comprises:

two opposing side frame members;

a top member having a pair of opposite ends, the top member being attached at each end to and extending between the opposing side members; and a bottom member having a pair of opposite ends, the bottom member being attached at each end to and extending between the opposing side members, the bottom member positioned at the opposite end of the side members from the top member.

3. A device as claimed in claim 1 wherein the opposing side frame members are positioned parallel to one another and wherein the top and bottom members are substantially perpendicular to the side members.

4. A device as claimed in claim 3 wherein the side frame members and the top and bottom frame members are made of aluminum.

5. A device as claimed in claim 4 wherein the side frame members and the top and bottom frame members are hollow extrusions.

6. A device as claimed in claim 1, wherein the securing means further comprises:

at least one pallet clamp disposed on one of the opposing side frame members, the pallet clamp having first and second clamping members hingedly connected to one another, the first clamping member mounted on a top surface of the side frame member, and the second clamping member being disposed at a distance below the bottom surface of the side member;

a resilient member projecting from the second clamping member toward the first clamping member, the resilient member adapted to engage the underside of a pallet upon positioning the frame members on the surface of the pallet and closing the pallet clamp; and means for releasably holding the first and second clamping members in a closed clamping position.

7. A device as claimed in claim 6 wherein the holding means comprises a pair of magnets, one magnet provided on each of the pallet clamp members, one magnet of the pair mounted on the first clamping member and the other magnet mounted on the opposite clamping member, the magnets positioned to create an attractive closing force for the clamping members to releasably secure the pallet clamp in the closed position.

8. A device as claimed in claim 1 wherein the height adjustment means comprises:

a plurality of threaded shafts rotatably secured within various positions on the members of the frame, the shafts each having a flat distal end which projects below the lower surface of the frame members in which they are rotatably secured; and means for rotation of the shafts to adjust the amount of projection of the flat ends from the bottom surface of the setup frame.

9. A device for setting up a uniform off-contact distance in a screen printing machine, the screen printing machine being of the type having a multiplicity of printing stations, each station having a pallet and a printing frame holding assembly for securing a screen printing frame for purposes of screen printing on a substrate positioned on the pallet, means for relative movement of the pallets and the secured printing frames, the setup device comprising:

a rigid frame, the frame being generally planar and adapted to be engaged by the frame holding assembly of the printing station, the frame comprising two opposing, parallel side frame members, a top member having a pair of opposite ends, the top member being attached at each end and extending perpendicular to the opposing side members, and a bottom member having a pair of opposite ends, the bottom member being attached at each end and perpendicular to the opposing side members, the bottom member positioned at the opposite end of the side members from the top member;

a pair of pallet clamps positioned on each of the opposing side members, the clamps adapted to releasably secure the rigid frame on the surface of the pallet of the printing station; and a plurality of threaded shafts rotatably secured at various positions on the side members of the rigid frame, the shafts each having a flat distal end which projects below the side members in which they are rotatably secured, and means for rotation of the shafts to adjust the amount of projection of the flat ends from the bottom surface of the rigid frame, the adjustment of the projection of the threaded shafts adjusting the relative height of the rigid frame with respect to the surface of the pallet to which it is secured.

10. A device as claimed in claim 9, wherein the pallet clamps further comprise:

a first and second clamping member hingedly connected to one another, the first clamping member mounted on a top surface of the side frame member, and the second clamping member being disposed at distance below the bottom surface of the side member;

a resilient member projecting from the second clamping member toward the first clamping member, the resilient member adapted to engage the underside of a pallet upon positioning the frame members on the surface of the pallet and closing the pallet clamp; and means for releasably holding the first and second clamping members in a closed clamping position.

11. A device as claimed in claim 10 wherein the holding means comprises a pair of magnets, one magnet provided on each of the pallet clamp members, one magnet of the pair mounted on the first clamping member and the other magnet mounted on the opposite clamping member, the magnets positioned to create an attractive closing force for the clamp members to releasably secure the pallet clamps in the closed position.

12. A method for setting uniform off-contact distance in a screen printing machine comprising the steps of:

releasably securing a setup frame to a pallet on a multi-station screen printing press;

setting the position of the setup frame at a specified height off of the pallet;

securing a frame holding assembly from one station on the printing press to the setup frame secured to the pallet;

fixing the height and level adjustments of the frame holding assembly to the position of the setup frame on the pallet;

releasing the fixed frame holding assembly from the setup frame;

securing a frame holding assembly from another station on the printing machine to the setup frame secured to the pallet;

fixing the height and level adjustments of the frame holding assembly on the second station to the position of the setup frame on the pallet;

releasing the setup frame from the pallet;

securing the setup frame to another pallet on the printing press;

fixing the height and level adjustments of the pallet to the position of the setup frame as retained by the fixed frame holding assembly;

releasing the setup frame from the pallet; and removing the setup frame from the frame holding assembly.

* * * * *